US010371464B2

(12) United States Patent
Abell et al.

(10) Patent No.: US 10,371,464 B2
(45) Date of Patent: Aug. 6, 2019

(54) TUBE HEADER FOR HEAT EXCHANGER

(71) Applicant: MAHLE International GmbH, Stuttgart (DE)

(72) Inventors: Bradley D. Abell, Clarkston, MI (US); Nicholas A. Potter, Livonia, MI (US); Jeffrey A. Dunker, Englewood, OH (US); David A. Nagel, Jr., Rochester Hills, MI (US)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 424 days.

(21) Appl. No.: 14/793,135

(22) Filed: Jul. 7, 2015

(65) Prior Publication Data

US 2017/0010058 A1 Jan. 12, 2017

(51) Int. Cl.

| | |
|---|---|
| ***F28F 9/02*** | (2006.01) |
| ***F28D 1/053*** | (2006.01) |
| ***F28F 9/18*** | (2006.01) |

(52) U.S. Cl.

CPC ..... *F28F 9/0246* (2013.01); *F28D 1/05366* (2013.01); *F28F 9/0224* (2013.01); *F28F 9/18* (2013.01); *F28F 2255/02* (2013.01); *F28F 2265/26* (2013.01)

(58) Field of Classification Search

CPC ..... F28F 9/0246; F28F 9/0224; F28F 9/18; F28F 2255/02; F28F 2265/26; F28D 1/05366

See application file for complete search history.

(56) References Cited

U.S. PATENT DOCUMENTS

| | | | | |
|---|---|---|---|---|
| 4,159,741 | A * | 7/1979 | Nonnenmann | F28F 9/16 165/173 |
| 5,092,397 | A | 3/1992 | Fuhrmann et al. | |
| 5,159,826 | A | 11/1992 | Miyazawa et al. | |
| 5,366,006 | A | 11/1994 | Lu et al. | |
| 5,921,130 | A | 7/1999 | Yamada | |
| 6,446,337 | B1 * | 9/2002 | Halm | F28F 9/182 29/527.2 |
| 6,932,152 | B2 | 8/2005 | Iwasaki et al. | |
| 7,007,745 | B2 * | 3/2006 | Iwasaki | F28F 9/0226 165/173 |
| 7,413,006 | B2 | 8/2008 | DeGroot et al. | |

(Continued)

FOREIGN PATENT DOCUMENTS

| | | |
|---|---|---|
| DE | 100 16 029 A1 | 10/2001 |
| DE | 103 43 239 A1 | 4/2005 |

(Continued)

*Primary Examiner* — Jon T. Schermerhorn, Jr.

(74) *Attorney, Agent, or Firm* — Brinks Gilson & Lione

(57) ABSTRACT

A tube header for a heat exchanger includes a header plate having two major dimensions defining a header plane. The header plate has a row of oblong passages extending through the header plate. Each passage is bordered by a ferrule monolithically formed with the header plate. The ferrule has a surrounding wall extending perpendicular to the header plane. A transitional area between the ferrule and the header plate has a reduced thickness that is smaller than the wall thickness of the ferrule. This transitional area provides a flexible hinge-like function for compensating dimensional changes during thermal cycles of a heat exchanger.

18 Claims, 4 Drawing Sheets

(56) References Cited

U.S. PATENT DOCUMENTS

| | | | | |
|---|---|---|---|---|
| 2005/0167091 | A1* | 8/2005 | Juschka | F28D 7/1684 165/173 |
| 2007/0000657 | A1 | 1/2007 | Emrich et al. | |
| 2007/0012425 | A1* | 1/2007 | Sugito | F28D 1/05366 165/81 |
| 2007/0240446 | A1* | 10/2007 | Holtzapple | B01D 1/0058 62/333 |
| 2010/0038063 | A1 | 2/2010 | Saumweber et al. | |
| 2010/0233572 | A1* | 9/2010 | Yajima | H01M 8/04007 429/483 |
| 2011/0139424 | A1 | 6/2011 | Bensel et al. | |
| 2014/0054018 | A1 | 2/2014 | Augenstein et al. | |

FOREIGN PATENT DOCUMENTS

| | | | | |
|---|---|---|---|---|
| DE | 102006045200 | A1 | 4/2008 | |
| DE | 102006056774 | A1 | 6/2008 | |
| DE | 10 2007 059 673 | A1 | 8/2008 | |
| DE | 10 2011 075 071 | A1 | 11/2012 | |
| EP | 0 389 970 | A2 | 10/1990 | |
| EP | 0 745 823 | A1 | 12/1996 | |
| EP | 2 151 655 | A2 | 2/2010 | |
| GB | 2453128 | A * | 4/2009 | F28F 9/02 |
| WO | 2008/071362 | A1 | 6/2008 | |
| WO | 2010/003445 | A1 | 1/2010 | |

* cited by examiner

TUBE HEADER FOR HEAT EXCHANGER

TECHNICAL FIELD OF THE INVENTION

The present application relates to a tube header of a heat exchanger and to a heat exchanger with such a tube header.

BACKGROUND

Heat exchangers are used to transfer heat from one fluid to another fluid. Heat exchangers have various uses within an automotive vehicle. For example, in a radiator, heat is transferred from a cooling liquid to the ambient air. In particular in motor vehicles the heat exchanger is used to discharge waste heat released by the internal combustion engine into the ambient air. The cooling medium that flows through the heat exchanger may be a liquid or, in some applications, a gaseous fluid.

Heat exchangers of the radiator type include a plurality of parallel tubes and two header boxes. The header boxes are typically two-part structures consisting of a header tank and a tube header. The tube header includes a central header plate with passages bordered by side walls forming a ferrule. The ends of the tubes are inserted into the ferrules to establish a fluid communication between the tube header and the interior volume of the tubes. The tubes may be formed from folded or welded sheet metal. While welded tubes are generally more durable, folded tubes are less costly to manufacture.

During operation, the service life of the heat exchanger may be shortened due to non-uniform expansion of the individual components of the heat exchanger when heating up and cooling down and the deformation or displacement resulting therefrom. The stresses can be attributed to the changing thermal conditions in the heat exchanger. The service life of a heat exchanger may thus be shorter for heat exchangers with folded tubes than for those with welded tubes.

In the past, attempts have been made to extend the service life of heat exchangers by modifying the transition between the tube header and the inserted folded tubes, with limited success.

SUMMARY OF THE INVENTION

It is therefore an object of the present application to provide a tube header for a heat exchanger in which the service life of the heat exchanger is extended without detriment despite the use of economically manufactured tubes.

According to an embodiment of the invention, the object is attained by a tube header for a heat exchanger comprising a header plate having two major dimensions defining a header plane, the header plate having a row of oblong passages extending through the header plate. Each passage is bordered by a ferrule monolithically formed with the header plate. The ferrule has a surrounding wall extending perpendicular to the header plane. A transitional area between the ferrule and the header plate has a reduced thickness that is smaller than the wall thickness of the ferrule. This transitional area provides a flexible hinge-like function for compensating dimensional changes during thermal cycles of a heat exchanger.

The passages have a pair of opposing wide sides and a pair of opposing narrow sides, and each transitional area may have a taper toward the ferrule at least along the wide sides of each passage. The taper gradually reduces the thickness of the header plate toward the transitional area, thereby avoiding abrupt changes in the thickness of the header plate.

For example, the taper may have a slope angle relative to the header plane in a range of 45° through 80°. Preferably, the slope angle is in a range of 60° through 66°.

The reduced thickness has a minimum thickness in a portion of the taper close to the ferrule, which corresponds to the transition of the ferrule to the header plate and the location at which the tubes come out of contact with the ferrules.

For example, the reduced thickness of the transitional area may be within a range of 15% through 70% of the maximum plate thickness of the tube header, corresponding to a reduction in a range of 30% through 85%. Preferably, the reduced thickness of the transitional area amounts to at most 50% of the maximum plate thickness, corresponding to a reduction by at least 50% of the maximum thickness of the tube header, for an enhanced hinge function.

In absolute measurements, the reduced thickness of the transitional area is preferably within a range of 0.3 through 0.6 mm for increased durability and reduced risk of a potential premature failure.

The row of the oblong passages defines a row direction and each passage has a pair of opposing wide sides and a pair of opposing narrow sides. The passages are arranged on the header plate with the wide sides extending perpendicular to the row direction. Between adjacent passages, the header plate preferably includes trough-shaped tie bars for a corrugation effect resulting in improved dimensional stability against warping. For this purpose, the tie bar may have side walls with a side wall thickness that is greater than the wall thickness of the ferrules.

Furthermore, the tie bar may have a bottom thickness that is smaller than the side wall thickness. The thinner tie bar bottom provides a further flexible hinge in the fashion of an accordion pleat that can compensate for thermal expansion and contraction.

The ferrule may have a straight remote edge extending at a constant distance from the header plane and may also have a constant wall thickness, which simplifies the manufacturing process.

For example, the ferrule may have a length of at least 1 mm perpendicular to the header plane from the remote edge to the transitional area for proper alignment with the tubes inserted through the passages.

The header plate has at least one attachment portion for affixing the tube header to a header tank, the attachment portion extending perpendicular to the header plane in the same direction as the ferrules so that the ferrules point inward into the header box.

According to a further aspect of the present invention, a heat exchanger with at least one header box and a plurality of tubes extending therefrom has a tube header as described above.

The tube header permits the use of folded sheet metal tubes with increased and more consistent durability compared to existing heat exchangers. The tube header is likewise suited for welded tubes. In the heat exchangers, the ferrule preferably has a length perpendicular to the header plane and terminates in a remote edge at a free end. The tubes coextend along the length of the ferrule and preferably terminate beyond the remote edge inside the header box. Thus, the ferrules preferably extend toward the interior of the header box.

Further aspects and benefits of the present invention will become apparent from the following detailed description of the attached drawings. However, the detailed description and the specific examples shown in the drawings are provided for illustrative purposes only and are not intended to limit the scope of the present invention

DETAILED DESCRIPTION

Figure 1:
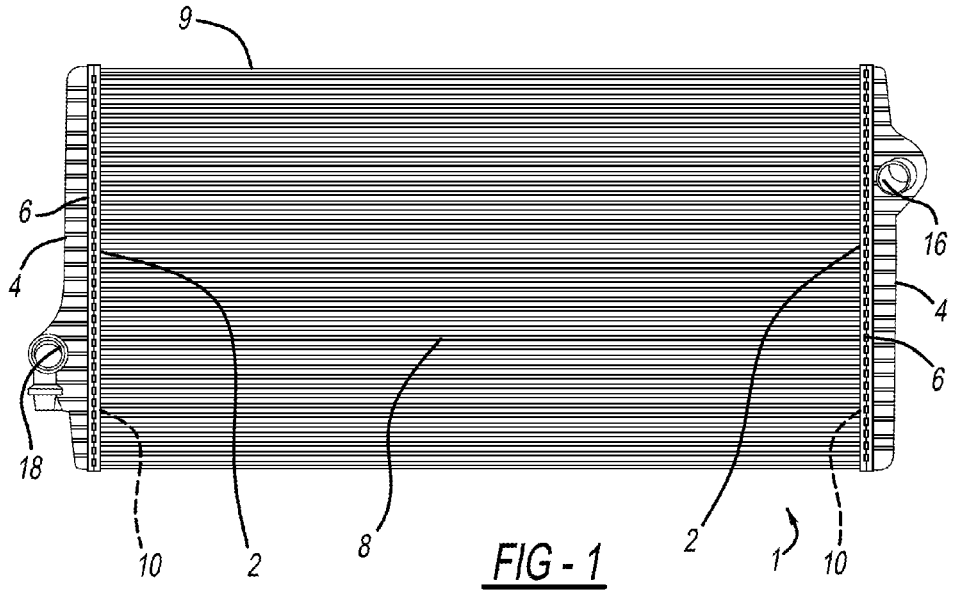
FIG. 1 is a perspective view of a heat exchanger according to one aspect of the present invention.

FIG. 1 shows a heat exchanger 1 that has two opposing tube headers 2. Each tube header 2 is attached to a header tank 4 indicated in broken lines. The tube headers 2 and the header tanks 4 form two header boxes 6 on opposite ends of the heat exchanger 1. The shape of the header tanks 4 is dictated by the architecture of the vehicle, in which the heat exchanger 1 is to be installed, and the indicated header tanks 4 only constitute a general schematic representation of header tanks 4 that may have different shapes and may have additional features, for example for installation of the heat exchanger 1 in a vehicle or for attaching sensors to the header tank. The header tanks 4 may be formed from injection-molded plastic that may include reinforcement structures, such as stiffening ribs 7 located on the outside of the header tanks 4.

Arranged between the tube headers 2 are tubes 8 with elongated cross-sections. The tubes 8 are placed adjacent to one another and extend parallel to one another in a row. The tubes 8 have tube ends 10 that pass through passages 12 in the tube header 2 as will be explained in greater detail in connection with FIG. 5. The tubes 8 bring the two header boxes 6 in fluid communication with each other. Cooling fins 14, which are elongated flat metal strips bent in a zigzag or serpentining shape (see FIG. 5), are placed between adjacent tubes 8 for increasing the cooling surface of the heat exchanger 1. The matrix of alternating tubes 8 and cooling fins 14 is bordered at each end by a core cover 9 extending from one tube header 2 to the other and forming an outer surface of the heat exchanger 1.

When the heat exchanger 1 is designed as radiator, the cooling medium enters an interior of one of the two header boxes 6 through an inlet opening 16 provided in the header box 6. The cooling medium to be cooled distributes itself in the interior, enters the tubes 8, and flows through them. In this process, cooling of the hot cooling medium takes place via the surfaces of the tubes 8 and of the cooling fins 14, and the cooled cooling medium in turn enters an interior of the other header box 6 at the other tube ends 10 of the tubes 8. The other header box 6 contains an outlet opening 18, through which the cooling medium, which has in the meantime been cooled, is delivered to the device to be cooled, for example the internal combustion engine.

The tubes 8 and the cooling fins 14 located between them are exposed to a cooling air flow. In this process, the heat energy of the hot cooling medium flowing through the tubes 8 is transferred to the surfaces of the tubes 8 and from there to the cooling fins 14, and is then carried away by the cooling air flow.

Figure 2:
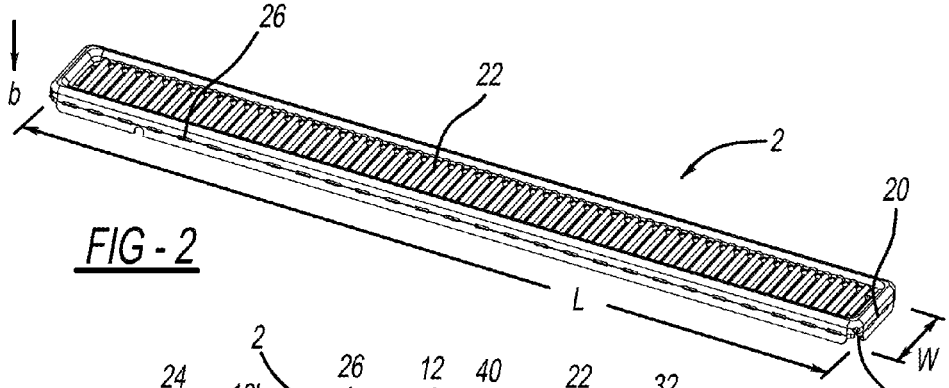
FIG. 2 is a perspective view of a tube header suited for the heat exchanger of FIG. 1.

FIG. 2 shows the general dimensions of a tube header 2 suited for the use in a heat exchanger 1 of the type shown in FIG. 1. The tube header 2 of FIG. 2 is shown from a side outside of a header box 6, which is the side from which, in the assembled state of FIG. 1, tubes 8 extend toward the second tube header 2 of a heat exchanger 1. In FIG. 2, the tubes 8 would extend upward. The tube header 2 is manufactured from cold-formed sheet metal, for example aluminum.

The length L and the width W of the tube header 2, constituting the two greatest dimensions of the tube header 2, define a header plane A. In the perspective of FIG. 2, the length L, forming the greatest dimension of the tube header 2, extends sideways along the image plane, and the width W extends into the image plane.

The tube header 2 has a generally rectangular outer periphery bordered by attachment portions in the form of flanges 20 extending along each of the four sides of the periphery for attaching the tube header 2 to the header box 6. From a central header plate 22 that extends in the header plane A, the flanges 20 extend transverse to the header plane A toward the header box 6 and are separated from each other by slots 24 in the four corners of the tube header 2 for added flexibility during assembly. Punched perforations 26 in the flanges 20 further add to the flexibility of the flanges 20.

The header plate 22 of the tube header 2 bears a row of ferrules 28 alternating with tie bars 30. The ferrules 28 surround elongated passages 12 extending along the direction of the width W of the tube header 2. The elongated passages 12 match the elongated cross-section of the tubes 8, with two opposing wide sides and two opposing narrow sides. Each of the ferrules 28 forms a wall 32 surrounding one of the passages 12. The wall 32 extends toward the interior of the header box 6. The tie bars 30 provide a corrugation of the tube header 2 and thus provide increased stability for the overall structure of the tube header 2. To this end, the tie bars 30 are trough shaped and are arranged parallel to the passages 12. The bottoms 34 of the tie bars 30 point toward the outside of the header box 6.

Figure 3:
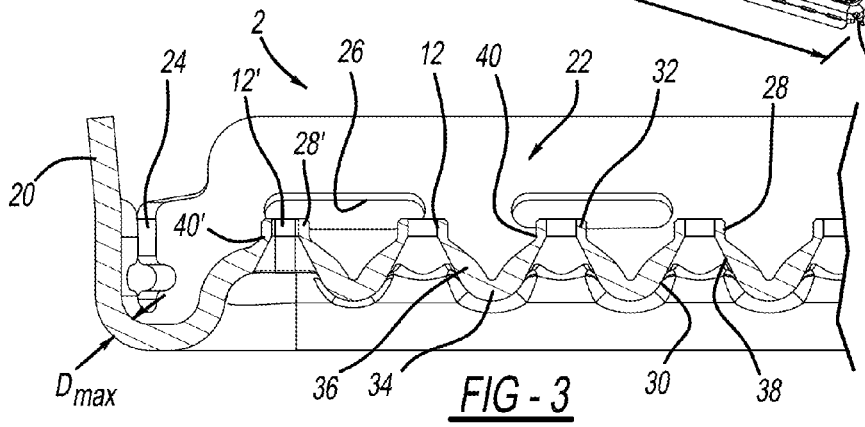
FIG. 3 is a cross-sectional detail view of any of the tube headers of FIGS. 1-6 in a plane perpendicular to the views of FIGS. 4-6.
Figure 4:
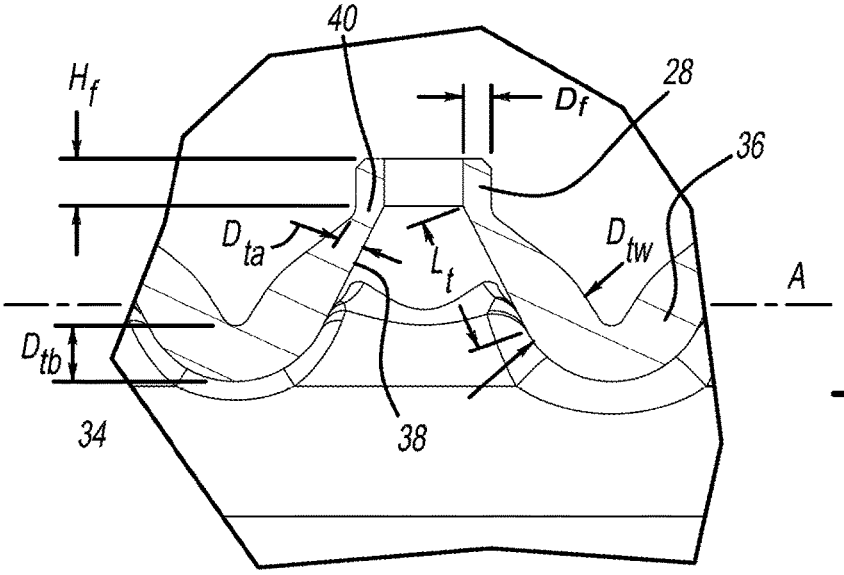
FIG. 4 shows a magnified detail of FIG. 3.

FIG. 3 shows a partial cross-section of a tube header 2 as shown in FIG. 2, with an enlarged detail shown in FIG. 4. The tube header 2 is composed of the header plate 22, the flanges 20, and the ferrules 28. The header plate 22 includes the row of oblong passages 12 extending through the header plate 22. Each passage 12 is bordered by a ferrule 28 monolithically formed with the header plate 22. Each of the ferrules 28 has a surrounding wall 32 extending perpendicular to the header plane A. Between adjacent passages 12, the header plate 22 includes tie bars 30 alternating with the passages 12. The tie bars 30 are trough-shaped and thus provide additional dimensional stability to the tube header 2 via a corrugation effect. The tube header 2 has a maximum thickness $D_{max}$ that is present, for example, in an area where the header plate 22 transitions into the flanges 20.

Now referring to FIG. 4, the ferrules 28 have a wall thickness $D_f$ that is smaller than the maximum thickness $D_{max}$ of the tube header 2. For example, the wall thickness $D_f$ of the ferrules 28 may be about 30% to 50% of the maximum thickness $D_{max}$ of the tube header 2. In contrast thereto, the trough-shaped tie bars 30 have side walls 36 with a local thickness $D_{tw}$ that may be equal to or only slightly smaller than the maximum thickness $D_{max}$. Preferably, the bottom 34 of the tie bar 30 has a reduced thickness $D_{tb}$ in comparison with the side walls 36.

The side walls 36 transition into a tapered portion 38 with a gradually reduced thickness toward the ferrule 28. Outside of the header box 6, the tapered portion 38 forms a steady slope over a taper length $L_t$ that is greater than the height $H_f$ of the ferrule 28, thus avoiding an abrupt change in the thickness of the header plate 22. The tapered portion 38 has a constant slope angle relative to the header plane A in a range of 45° through 80°, i.e. an angle of 10° to 45° relative to the tubes 8. Preferably, the slope angle is in a range of 60° through 66°, thus 24° through 30° relative to the direction of the tubes 8 shown in FIG. 5. At the transition from the tapered portion 38 to the ferrules 28, the thickness $D_{ta}$ of the tube header 2 has a minimum that is smaller than the thickness $D_f$ of the ferrule wall 32.

Figure 5:
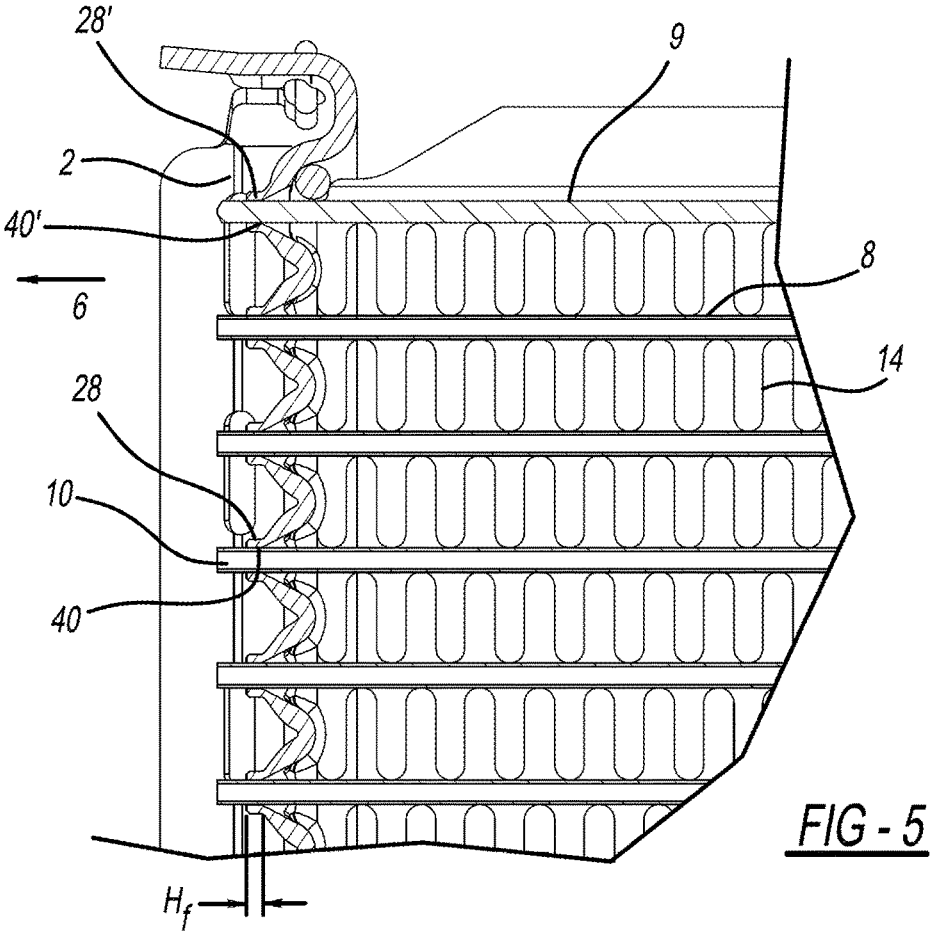
FIG. 5 corresponds to the cross-sectional detail view of FIG. 3 with tubes inserted.

FIG. 5 shows a cross-sectional view corresponding to FIG. 3, but with tubes 8 attached to the tube header 2. Between the tubes 8, serpentining cooling fins 14 provide large cooling surfaces. The tubes 8, which have elongated cross-sections, are carried in the ferrules 28 of the tube header 2 and extend beyond the ferrules 28 into the interior of the header box 6. The tubes 8 extend past the free ends of the ferrules 28 by a length that is at least equal to the height $H_f$ of the ferrule 28. The transitional area 40 between ferrule 28 and tapered portion 38 is the area where the tube transitions from contacting the ferrule 28 with the tube surface to being out of contact with the tube header 2. Thus, the minimum thickness $D_{ta}$ (see FIG. 4) of the tube header 2 is located in the transitional areas 40 directly adjacent the ferrules 28 making contact with the tubes 8. The added flexibility of the reduced thickness $D_{ta}$ provides for better compensation of thermal stress. The tubes 8 are brazed to the ferrules 28. The tubes 8 are joined together with the ferrules 28 by melting a filler metal with a lower melting point and making it flow into the overlapping length, thereby creating a fluid-tight connection.

Figure 6:
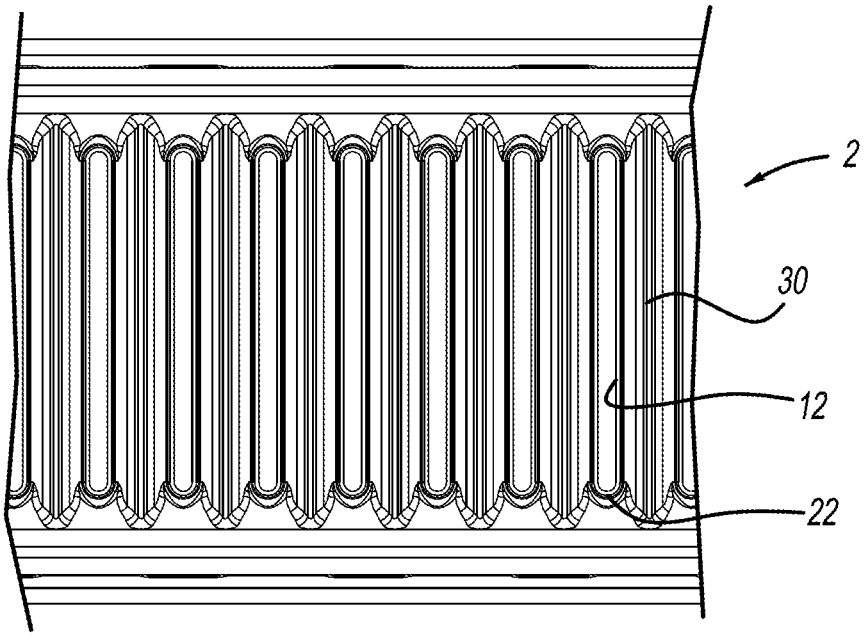
FIG. 6 illustrates a detail view of a first embodiment of a tube header according to FIG. 2.
Figure 7:
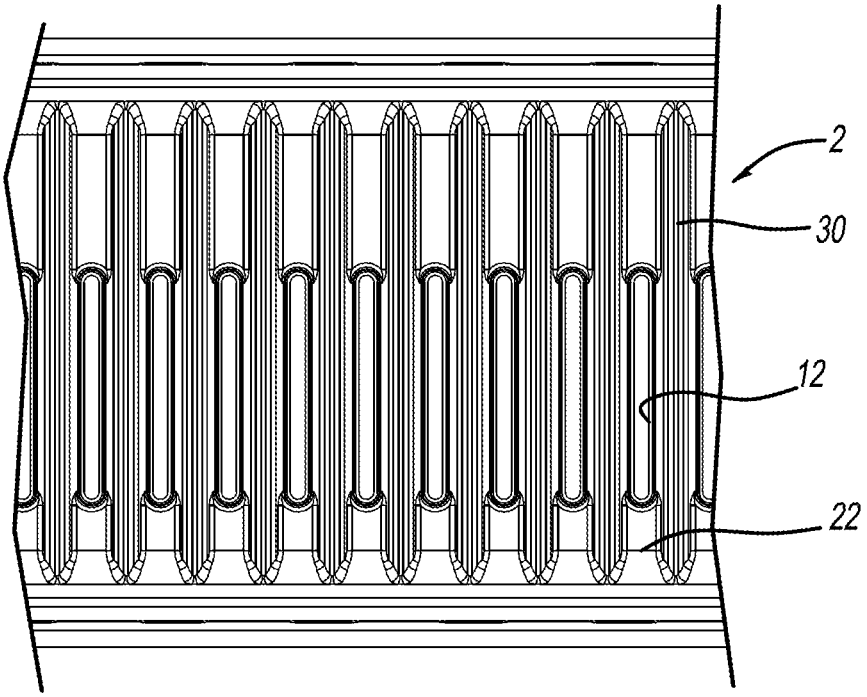
FIG. 7 illustrates a detail view of a second embodiment of a tube header according to FIG. 2.

FIGS. 6 and 7 show partial view onto a tube header 2 from the outside of the header box 6. While the tie bars 30 extend generally across the entire header plate 22, the passages 12 for inserting the tubes 8 may occupy varying portions of the width of the header plate 22.

FIG. 6 shows an example, in which the tube header 2 has a relatively narrow width W and the wide sides of the passages 12 are nearly as long as the tie bars 30. This arrangement is shown in a cross-sectional view in FIG. 8. In this cross-sectional view of FIG. 8, the ferrules 28, transitional areas 40, and tapered portions 38 are very similar to those shown in FIGS. 3-5 in a plane perpendicular to the plane of FIG. 6.

In FIG. 7. The header plate 22 of the tube header 2 has a significantly greater width W than the length of the wide sides of passages 12. As evident from FIG. 9, the header plate 22 includes flat portions 42 extending in the header plane A between adjacent tie bars 30, from the ends of the passages 12 to the edges of the header plate 22. In FIG. 9, the tube header 2 is wider than in FIG. 8. The width W of the tube header 2 depends on the vehicle, in which the heat exchanger 1 is to be installed.

Figure 8:
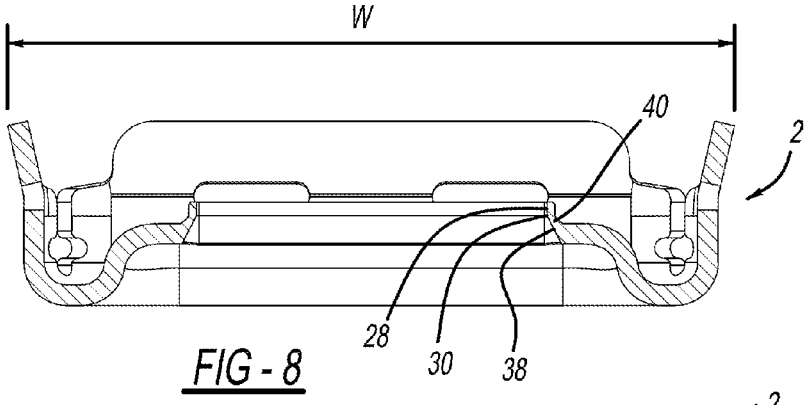
FIG. 8 is a cross-sectional view of the tube header illustrated in FIG. 6.
Figure 9:
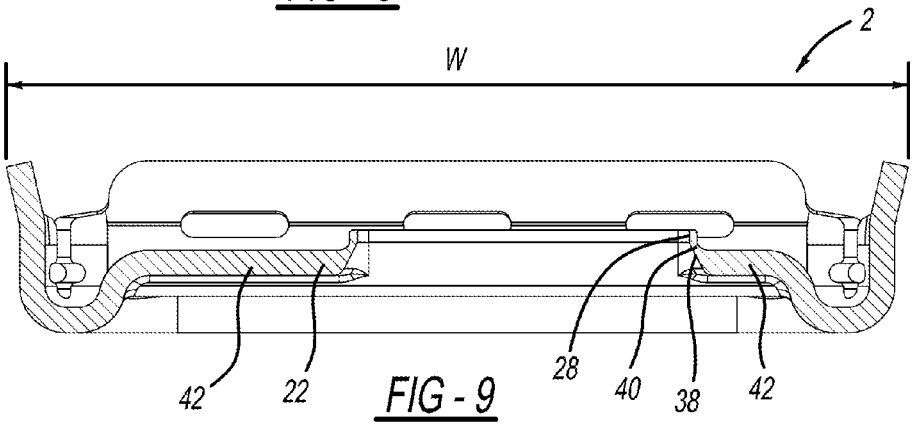
FIG. 9 is a cross-sectional view of the tube header illustrated in FIG. 7.
Figure 10:
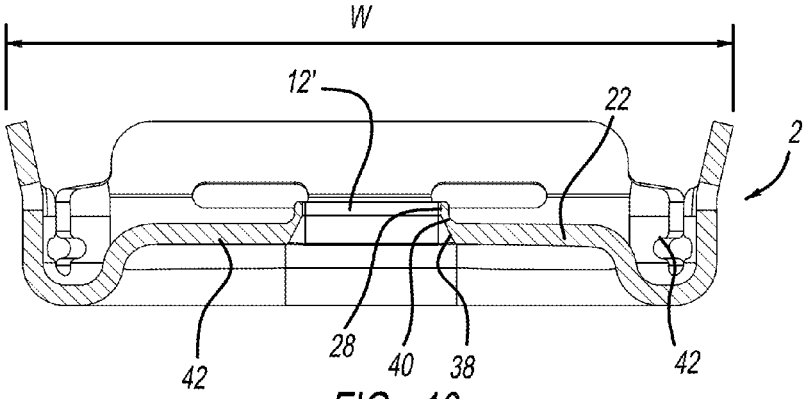
FIG. 10 is a cross-sectional view of the tube header of FIGS. 6 and 8 in a plane through an outermost ferrule.

FIG. 10 shows a cross-section of the tube header 2 of FIGS. 6 and 8 through one of the ferrules 28' surrounding the passage 12' that forms the end of the row of passages 12 and 12' (see FIG. 3). Instead of a tube, the ferrule 28' holds a core cover 9 (see FIGS. 1 and 5). Core covers are formed sheets of metal, for example aluminum, on each side of the heat exchanger 1. The ferrule 28' is generally shaped like the ferrules 28 holding the tubes 8, but with a shorter wide side, i.e. a smaller dimension in the direction of the width W. The transitional area 40' forms a minimum thickness between the ferrule 28' and the taper 38'. Thus, flexible hinges are provided not only for the tubes 8, but also for the core covers 9. In this first embodiment of the tube header 2, the passages 12' for the core cover 9 are arranged centrally in the header plate 22 with respect to the width W, like the passages 12 of FIGS. 6 and 8. A corresponding cross-section of the second embodiment of the tube header 2 of FIGS. 7 and 9 is not shown in a separate drawing. The ferrule 28' for the core cover 9 of the second embodiment would be arranged in alignment with the row of passages 12 and thus would be offset from the center of the tube header 2 with respect to the width W. Alternatively, in an embodiment not shown, the core covers may not be inserted into ferrules, but wrapped around the ends of the heat exchanger so that the passages 12' and the ferrules 28' for the core covers 9 may be omitted.

All of these embodiments have in common that the tapered portion 38 is present around the entire periphery of the passages 12, along the wide sides of the passages 12 as well as along the narrow sides. The tapered portions 38 formed on the narrow side and the wide side serve as insertion aids in the fashion of funnels facing in the insertion direction of the tube. Thus, the tapered portions 38 assist the installation of the tubes 8 in the ferrules 28. The embodiments further have in common that the ferrule 28 has a greater wall thickness $D_f$ than the transitional area 40 $D_{ta}$ both along the wide sides of the passages 12 and along the narrow sides. As these embodiments show, the tube headers 2 as presented may be modified to meet various dimensional specifications. For applying the varying thicknesses of the tube header 2 and forming the passages 12 surrounded by the ferrules 28, a pierced stamping technique may be utilized.

In one example, the maximum thickness of the tube header 2 may be 1.2 mm. The thickness of the bottom 34 of the tie bar may be about 0.8 mm, the side walls 36 about 1.1 mm, the ferrules 28 about 0.6 mm, and the thickness of the transition between the tapered portion 38 of the header plate 22 and the lower edge of the tie bar may be about 0.5 mm. These measurements may be varied. For example, the transitional area 40 may have a greater thickness. In turn, the thickness of the ferrule 28 would then increase accordingly.

The transitional area 40 between the ferrules 28 and the header plate 22, where the tube would meet the tube header 2, is dimensioned to promote flexibility in the ferrule 28 and removes rigidity of the interface between the tube and the tube header 2 so that more stress can be transferred from the tube to the ferrule 28 during thermal cycling. The tie bar between the ferrules 28 also incorporates flexibility due to the reduced thickness of the bottom 34 for optimal thermal cycle performance, while adding dimensional stability against warping for improved pressure cycle performance. Both thinned areas in the transition between ferrules 28 and header plate 22 as well as at the bottom 34 of the tie bars 30 provide flexible hinges.

Tube headers 2 for radiators are typically available in a range of maximum thicknesses of 1 mm through 2.5 mm. The minimum thickness of the tube header according to the present application is in the transitional area 40 between the ferrules 28 and the tapered portion 38. The average durability of the heat exchanger needs to meet customer specifications, and the performance should be satisfactorily consistent among heat exchangers 1 of identical build.

It has been found that the performance of the tube headers 2 was optimized when the thinning of the transitional areas 40 amounted to a minimum thickness between 0.3 mm and 0.6 mm, corresponding to a thickness reduction by 50% through 75% for a maximum thickness of 1.2 mm, to a reduction by 60% through 80% for a maximum thickness of 1.5 mm, and to a reduction by 70% through 85% for a maximum thickness of 2 mm. The indicated range is approximate. In particular, the lower limit depends on manufacturing tolerances. If the minimum thickness is too small, the manufacturing tolerances may result in a locally fragile transitional area, while thicknesses too great may not provide the desired hinge function.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

The invention claimed is:

1. A tube header for a heat exchanger comprising a header plate having two major dimensions defining a header plane, the header plate having a core side and a header side and a row of oblong passages extending through the header plate, each passage bordered by a ferrule monolithically formed with the header plate, the ferrule having a surrounding wall extending from the header plate on the header side perpendicular to the header plane and having a wall thickness; and a transitional area between the ferrule and the header plate having a reduced thickness that is smaller than the wall thickness of the ferrule, wherein the header plate is made of cold-formed sheet metal, wherein each passage has a pair of opposing wide sides and a pair of opposing narrow sides, each transitional area is formed at an end of a taper with a steady slope toward the ferrule on the core side over a taper length at least along the wide sides of each passage, the taper gradually reducing the thickness of the header plate toward the transitional area, wherein the reduced thickness reaches a minimum thickness in a portion of the taper within the taper length and close to the ferrule.

2. The tube header according to claim 1, wherein the taper has a slope angle relative to the header plane in a range of 45° through 80°.

3. The tube header according to claim 2, wherein the slope angle is in a range of 60° through 66°.

4. The tube header according to claim 1, wherein the tube header has a maximum thickness and the reduced thickness of the transitional area is within a range of 15% through 70% of the maximum thickness of the tube header.

5. The tube header according to claim 4, wherein the reduced thickness of the transitional area amounts to at most 50% of the maximum thickness.

6. The tube header according to claim 1, wherein the reduced thickness of the transitional area is within a range of 0.3 through 0.6 mm.

7. The tube header according to claim 1, wherein the row of the oblong passages defines a row direction and each passage has a pair of opposing wide sides and a pair of opposing narrow sides, the passages being arranged on the header plate with the wide sides extending perpendicular to the row direction, and wherein the header plate includes trough-shaped tie bars between adjacent passages.

8. The tube header according to claim 7, wherein the tie bar has side walls with a side wall thickness that is greater than the wall thickness of the ferrules.

9. The tube header according to claim 8, wherein the tie bar has a bottom forming a fold adjoining the side walls and connecting the side walls to each other and a thickness of the bottom at the connecting fold is smaller than the side wall thickness of the connected side walls.

10. The tube header according to claim 1, wherein the ferrule has a remote edge extending at a constant distance from the header plane.

11. The tube header according to claim 10, wherein the ferrule has a length of at least 1 mm perpendicular to the header plane from the remote edge to the transitional area.

12. The tube header according to claim 1, wherein the ferrule has a constant wall thickness.

13. The tube header according to claim 1, wherein the header plate has at least one attachment portion for affixing the tube header to a header tank, the attachment portion extending perpendicular to the header plane in the same direction as the ferrules.

14. A heat exchanger with at least one header box and a plurality of tubes extending therefrom, the header box comprising a tube header having:

a header plate defining a header plane, the header plate having a core side and a header side and row of oblong passages extending through the header plate, each passage bordered by a ferrule monolithically formed with the header plate, the ferrule having a surrounding wall with a wall thickness extending perpendicular to the header plane; and wherein a transitional area between the ferrule and the header plate has a reduced thickness that is smaller than the wall thickness of the ferrule, and the header plate is made of cold-formed sheet metal, wherein each passage has a pair of opposing wide sides and a pair of opposing narrow sides, each transitional area is formed at an end of a taper with a steady slope toward the ferrule on the core side over a taper length at least along the wide sides of each passage, the taper gradually reducing the thickness of the header plate toward the transitional area, wherein the reduced thickness reaches a minimum thickness in a portion of the taper within the taper length and close to the ferrule.

15. The heat exchanger according to claim 14, wherein the tubes are folded sheet metal tubes.

16. The heat exchanger according to claim 14, wherein the ferrule has a length perpendicular to the header plane and terminates in a remote edge at a free end, each one of the plurality of tubes coextends along the length of one of the ferrules and terminates beyond the remote edge inside the header box.

17. The heat exchanger according to claim 14, wherein the ferrules extend from the header plane toward an interior of the header box.

18. The heat exchanger according to claim 14, further comprising a pair of core covers forming outer surfaces of the heat exchanger, each one of the core covers extending through an outermost one of the ferrules of the at least one tube header.

* * * * *